US006170583B1

(12) United States Patent
Boyce

(10) Patent No.: US 6,170,583 B1
(45) **Date of Patent: *Jan. 9, 2001**

(54) INSERTS AND COMPACTS HAVING COATED OR ENCRUSTED CUBIC BORON NITRIDE PARTICLES

(75) Inventor: James Edward Boyce, Cedar Hill, TX (US)

(73) Assignee: Dresser Industries, Inc., Dallas, TX (US)

( * ) Notice: Under 35 U.S.C. 154(b), the term of this patent shall be extended for 0 days.

This patent is subject to a terminal disclaimer.

(21) Appl. No.: 09/008,117

(22) Filed: Jan. 16, 1998

(51) Int. Cl.[7] ..... E21B 10/46

(52) U.S. Cl. ..... 175/426; 175/374

(58) Field of Search ..... 175/374, 426; 407/119; 51/295

(56) References Cited

U.S. PATENT DOCUMENTS

| | | | | |
|---|---|---|---|---|
| 3,389,761 | | 6/1968 | Ott | 175/374 |
| 3,461,983 | | 8/1969 | Hudson et al. | 175/375 |
| 3,497,942 | | 3/1970 | Weiss | 29/470 |
| 3,575,247 | | 4/1971 | Feenstra | 175/329 |
| 3,650,714 | | 3/1972 | Farkas | 51/295 |
| 3,757,878 | | 9/1973 | Wilder et al. | 175/329 |
| 3,768,984 | | 10/1973 | Foster, Jr. | 29/182.8 |
| 3,800,891 | | 4/1974 | White et al. | 175/374 |
| 3,841,852 | | 10/1974 | Wilder et al. | 51/295 |
| 3,850,590 | * | 11/1974 | Chalkey et al. | 51/298 |
| 3,871,840 | | 3/1975 | Wilder et al. | 51/295 |
| 3,894,673 | | 7/1975 | Lowder et al. | 228/122 |
| 3,922,038 | | 11/1975 | Scales | 308/8.2 |
| 3,986,842 | | 10/1976 | Quaas | 29/191.2 |
| 4,048,705 | | 9/1977 | Blampain et al. | 29/420 |
| 4,109,737 | | 8/1978 | Bovenkerk | 175/329 |
| 4,117,968 | | 10/1978 | Naidich et al. | 228/124 |
| 4,140,189 | | 2/1979 | Garner | 173/329 |
| 4,148,368 | | 4/1979 | Evans | 175/329 |
| 4,156,329 | | 5/1979 | Daniels et al. | 51/295 |

(List continued on next page.)

FOREIGN PATENT DOCUMENTS

| | | | |
|---|---|---|---|
| 0264674A | 4/1988 | (EP) . | |
| 0352811A | 1/1990 | (EP) . | |
| 462955 | 12/1991 | (EP) | E21B/10/56 |
| 2285213A | 4/1976 | (FR) . | |
| 08260129 | 10/1996 | (JP) . | |

OTHER PUBLICATIONS

Security/Dresser "Security Oilfield Catalog" Rock Bits, Diamond Products, Drilling Tools, *Security Means Technology*, Nov. 1991.

Security/DBS "PSF Premium Steel Tooth Bits with TECH2000 Hardfacing" 5M/4/95–SJ 1995 Dresser Industries, Inc.

Security/DBS "PSF MPSF with Diamond Tech2000 Hardfacing" 1995 Dresser Industries, Inc.

International Search Report, dated Nov. 7, 1996, re International Application PCT/US96/12462.

Security/DBS "tech.comm, The Most Complete Diamond Technology Family" 1997 Security DBS.

Clifford A. Kelto, "Rapid Omnidirectional Compaction," Special and Developing Processes, pp. 542–546 (no date).

*Primary Examiner*—William Neuder
*Assistant Examiner*—Zakiya Walker
(74) *Attorney, Agent, or Firm*—Groover & Associates; Robert Groover; Betty Formby

(57) ABSTRACT

An insert is provided for a rock bit for drilling bore holes in the ground and other downhole tools. The cutting portion of the inserts consist of encrusted cubic boron nitride pellets, tungsten carbide particles and a binder material which are fused together to form a unitary body. The cubic boron nitride particles of the fused insert are cubic in structure and substantially free of heat degradation and resultant hexagonal crystalline structure in response to fusing the elements together in a single step of simultaneously heating and compacting the elements.

25 Claims, 3 Drawing Sheets

U.S. PATENT DOCUMENTS

| | | | |
|---|---|---|---|
| 4,173,457 | 11/1979 | Smith | 51/309 |
| 4,173,685 | 11/1979 | Weatherly | 428/556 |
| 4,182,394 | 1/1980 | Cason, Jr. | 164/4 |
| 4,228,214 | 10/1980 | Steigelman et al. | 428/212 |
| 4,262,761 | 4/1981 | Crow | 175/374 |
| 4,274,840 | 6/1981 | Housman | 51/307 |
| 4,339,009 | 7/1982 | Busby | 175/374 |
| 4,341,557 | 7/1982 | Lizenby | 75/223 |
| 4,359,335 | 11/1982 | Garner | 75/208 |
| 4,376,793 | 3/1983 | Jackson | 427/34 |
| 4,398,952 | 8/1983 | Drake | 419/18 |
| 4,562,892 | 1/1986 | Ecer | 175/371 |
| 4,592,433 | 6/1986 | Dennis | 175/329 |
| 4,593,776 | 6/1986 | Salesky et al. | 175/375 |
| 4,597,456 | 7/1986 | Ecer | 175/371 |
| 4,604,106 | 8/1986 | Hall et al. | 51/293 |
| 4,630,692 | 12/1986 | Ecer | 175/330 |
| 4,656,002 | 4/1987 | Lizenby et al. | 419/10 |
| 4,666,797 | 5/1987 | Newman et al. | 428/681 |
| 4,679,640 | 7/1987 | Crawford | 175/374 |
| 4,682,987 | 7/1987 | Brady et al. | 51/293 |
| 4,688,651 | 8/1987 | Dysart | 175/371 |
| 4,694,918 | 9/1987 | Hall | 175/329 |
| 4,705,124 | 11/1987 | Abrahamson et al. | 175/410 |
| 4,708,752 | 11/1987 | Kar | 148/127 |
| 4,722,405 | 2/1988 | Langford, Jr. | 175/374 |
| 4,726,432 | 2/1988 | Scott et al. | 175/375 |
| 4,726,718 | 2/1988 | Meskin et al. | 408/145 |
| 4,729,440 | 3/1988 | Hall | 175/107 |
| 4,738,322 | 4/1988 | Hall et al. | 175/329 |
| 4,744,943 | 5/1988 | Timm | 419/10 |
| 4,770,907 | 9/1988 | Kimura | 427/217 |
| 4,781,770 | 11/1988 | Karr | 148/16.5 |
| 4,784,023 | 11/1988 | Dennis | 76/108 |
| 4,802,539 | 2/1989 | Hall et al. | 175/329 |
| 4,814,234 | 3/1989 | Bird | 428/564 |
| 4,836,307 | 6/1989 | Keshaven et al. | 175/374 |
| 4,861,350 | 8/1989 | Phaal et al. | 51/307 |
| 4,874,398 | 10/1989 | Ringwood | 51/293 |
| 4,938,991 | 7/1990 | Bird | 427/190 |
| 4,943,488 | 7/1990 | Sung et al. | 428/552 |
| 4,948,388 | 8/1990 | Ringwood | 51/308 |
| 4,956,012 | 9/1990 | Jacobs et al. | 75/236 |
| 4,976,324 | 12/1990 | Tibbitts | 175/329 |
| 4,985,051 | 1/1991 | Ringwood | 51/309 |
| 4,997,049 | 3/1991 | Tank et al. | 175/410 |
| 5,010,043 | 4/1991 | Ringwood | 501/90 |
| 5,025,874 | 6/1991 | Barr et al. | 175/329 |
| 5,051,112 | 9/1991 | Keshaven et al. | 51/309 |
| 5,106,393 | 4/1992 | Ringwood | 51/308 |
| 5,111,895 | 5/1992 | Griffin | 175/425 |
| 5,131,480 | 7/1992 | Lockstedt et al. | 175/374 |
| 5,143,523 | 9/1992 | Matarrese | 51/293 |
| 5,147,001 | 9/1992 | Chow et al. | 175/428 |
| 5,147,996 | 9/1992 | Carlin | 219/76.14 |
| 5,152,194 | 10/1992 | Keshavan et al. | 76/108 |
| 5,154,245 | 10/1992 | Waldenstrom et al. | 175/420 |
| 5,190,796 | 3/1993 | Iacovangelo | 427/304 |
| 5,199,832 | 4/1993 | Meskin et al. | 408/145 |
| 5,205,684 | 4/1993 | Meskin et al. | 408/145 |
| 5,206,083 | 4/1993 | Raj et al. | 428/323 |
| 5,224,969 | 7/1993 | Chen et al. | 51/295 |
| 5,230,718 | 7/1993 | Oki et al. | 51/293 |
| 5,232,469 | 8/1993 | McEachron et al. | 51/295 |
| 5,236,116 | 8/1993 | Solanski et al. | 228/178 |
| 5,248,006 | 9/1993 | Scott et al. | 175/420 |
| 5,250,086 | 10/1993 | McEachron et al. | 51/309 |
| 5,250,355 | 10/1993 | Newman et al. | 428/367 |
| 5,261,477 | 11/1993 | Brunet et al. | 164/97 |
| 5,273,125 | 12/1993 | Jurewicz | 175/420 |
| 5,279,374 | 1/1994 | Sievers et al. | 175/374 |
| 5,279,375 | 1/1994 | Tibbitts et al. | 175/428 |
| 5,282,512 | 2/1994 | Besson et al. | 175/374 |
| 5,282,513 | 2/1994 | Jones | 175/434 |
| 5,287,936 | 2/1994 | Grimes et al. | 175/331 |
| 5,288,297 | 2/1994 | Ringwood | 51/293 |
| 5,291,807 | 3/1994 | Vanderford et al. | 76/108 |
| 5,303,785 | 4/1994 | Duke | 175/57 |
| 5,308,367 | 5/1994 | Julien | 51/293 |
| 5,328,763 | 7/1994 | Terry | 428/559 |
| 5,335,738 | 8/1994 | Waldenstrom et al. | 175/420 |
| 5,337,844 | 8/1994 | Tibbitts | 175/434 |
| 5,341,890 | 8/1994 | Cawthorne et al. | 175/374 |
| 5,346,026 | 9/1994 | Pessier et al. | 175/331 |
| 5,348,108 | 9/1994 | Scott et al. | 175/432 |
| 5,348,770 | 9/1994 | Sievers et al. | 427/422 |
| 5,351,768 | 10/1994 | Scott et al. | 175/374 |
| 5,351,770 | 10/1994 | Cawthorne et al. | 175/374 |
| 5,351,771 | 10/1994 | Zahradnik | 175/374 |
| 5,351,772 | 10/1994 | Smith | 175/428 |
| 5,353,885 | 10/1994 | Hooper et al. | 175/378 |
| 5,355,750 | 10/1994 | Scott et al. | 76/108 |
| 5,370,195 | 12/1994 | Keshan et al. | 175/420 |
| 5,405,573 | 4/1995 | Clark et al. | 419/35 |
| 5,423,899 | 6/1995 | Krall et al. | 75/231 |
| 5,425,288 | 6/1995 | Evans | 76/108 |
| 5,429,200 | 7/1995 | Blackman et al. | 175/371 |
| 5,452,771 | 9/1995 | Blackman et al. | 175/353 |
| 5,469,927 | 11/1995 | Griffin | 175/432 |
| 5,486,137 | 1/1996 | Flood et al. | 451/540 |
| 5,594,931 | 1/1997 | Krall et al. | 419/5 |
| 5,606,895 | 3/1997 | Huffstutler | 76/108.4 |
| 5,609,286 | 3/1997 | Anthon | 228/56.3 |
| 5,633,084 | 5/1997 | Hiraiwa et al. | 428/403 |
| 5,647,449 | 7/1997 | Dennis | 175/434 |
| 5,667,903 | 9/1997 | Boyce | 428/558 |
| 5,755,298 | 5/1998 | Langford et al. | 175/374 |
| 5,755,299 | 5/1998 | Langford et al. | 175/375 |
| 5,890,552 * | 4/1999 | Scott et al. | 175/426 |

* cited by examiner

INSERTS AND COMPACTS HAVING COATED OR ENCRUSTED CUBIC BORON NITRIDE PARTICLES

RELATED APPLICATION

This application is related to copending patent applications Ser. No. 09/008,100 filed Jan. 16, 1998 entitled *Hardfacing Having Coated Ceramic Particles or Coated Particles of Other Hard Materials*; Ser. No. 09/008,373 filed Jan. 16, 1998 entitled *Inserts and Compacts Having Coated or Encrusted Diamond Particles*; Ser. No. 08/438,999 filed May 10, 1995 entitled *Method of Hard Facing a Substrate and Weld Rod Used in Hard Facing a Substrate*, now U.S. Pat. No. 5,667,903 dated Sep. 16, 1997; Ser. No. 08/579,454 filed Dec. 27, 1995 entitled *Hardfacing with Coated Diamond Particles,* now U.S. Pat. No. 5,755,299 dated May 26, 1998; and Ser. No. 08/818,468 filed Mar. 12, 1997 entitled *Hardfacing with Coated Diamond Particles,* now U.S. Pat. No. 5,755,298 dated May 26, 1998.

TECHNICAL FIELD OF THE INVENTION

The present invention relates generally to forming inserts and compacts having coated or encrusted cubic boron nitride particles dispersed within a matrix body and, more particularly, to improved inserts and compacts to protect drill bits and other downhole tools associated with drilling and producing oil and gas wells.

BACKGROUND OF THE INVENTION

In the search for energy producing fluids, such as oil and gas, it is often necessary to bore through extremely hard formations of the earth. Drill bits used in this industry are often tri-cone bits having roller cutter cones designed to scrape and gouge the formation. A cutter cone having broad, flat milled teeth can very effectively scrape and gouge the formation. However, as the formation being drilled becomes more dense and hard, such milled teeth wear quickly with accompanying reduction in drilling efficiency. Even when coated with an abrasion-resistant material, milled teeth often crack or break when they encounter hard formations. Thus, milled teeth are typically unsuitable for boring through high density rock.

To alleviate this problem, engineers have developed cutter cone inserts that are formed from a hard, abrasion-resistant material such as sintered and compacted tungsten carbide. Typically, such inserts or compacts have a generally frustoconical or chisel-shaped cutting portion and are rugged and extremely hard and tough. These physical properties are necessary to break and pulverize hard formations. These generally shorter, more rounded, and extremely hard and tough inserts function to crush the formation, as opposed to scraping, cutting and gouging pieces from the formation.

Rock bits with such previously available inserts improved the penetrations rates, resistance to insert wear and breakage, and maximized tolerance to impact and unit loading. However, problems exist in providing inserts that are more easily manufactured, have hard, wear resistant elements that are more easily retainable with the body of the insert and which are not cost prohibitive and can be easily obtained.

Rotary cone drill bits are often used for drilling boreholes for the exploration and production of oil and gas. This type of bit typically employs three rolling cone cutters, also known as rotary cone cutters, rotatably mounted on spindles extending from support arms of the bit. The cutters are mounted on respective spindles that typically extend downwardly and inwardly with respect to the bit axis so that the conical sides of the cutters tend to roll on the bottom of a borehole and contact the formation.

For some applications, milled teeth are formed on the cutters to cut and gouge in those areas that engage the bottom and peripheral wall of the borehole during the drilling operation. The service life of milled teeth may be improved by the addition of tungsten carbide particles to hard metal deposits on selected wear areas of the milled teeth. This operation is sometimes referred to as "hardfacing." U.S. Pat. No. 4,262,761, issued Apr. 21, 1981 discloses the application of hardfacing to milled teeth and is incorporated by reference for all purposes within this application.

For other applications, sockets may be formed in the exterior of the cutters and hard metal inserts placed in the sockets to cut and gouge in those areas that engage the bottom and peripheral wall of the borehole during the drilling operation. The service life of such inserts and cutters may be improved by carburizing the exterior surface of the cutters. U.S. Pat. No. 4,679,640 issued on Jul. 14, 1987 discloses one procedure for carburizing cutters and is incorporated by reference for all purposes within this application.

A wide variety of hardfacing materials have been satisfactorily used on drill bits and other downhole tools. A frequently used hardfacing includes sintered tungsten carbide particles in an alloy steel matrix deposit. Other forms of tungsten carbide particles may include grains of monotungsten carbide, ditungsten carbide and/or macrocrystalline tungsten carbide. Satisfactory binders may include materials such as cobalt, iron, nickel, alloys of iron and other metallic alloys. For some applications loose hardfacing material is generally placed in a hollow tube or welding rod and applied to the substrate using conventional welding techniques. As a result of the welding process, a matrix deposit including both steel alloy melted from the substrate surface and steel alloy provided by the welding rod or hollow tube is formed with the hardfacing. Various alloys of cobalt, nickel and/or steel may be used as part of the binder for the matrix deposit. Other heavy metal carbides and nitrides, in addition to tungsten carbide, have been used to form hardfacing.

Both natural and synthetic diamonds have been used in downhole drill bits to provide cutting surfaces and wear-resistant surfaces. U.S. Pat. No. 4,140,189 teaches the use of diamond inserts protruding from the shirttail surface of a roller cone bit. Polycrystalline diamond (PCD) gauge inserts are frequently used on a wide variety of drill bits to prevent erosion and wear associated with harsh downhole drilling conditions. U.S. Pat. No. 4,140,189 is incorporated by reference for all purposes within this application.

SUMMARY OF THE INVENTION

Accordingly, a need has arisen in the art for improved inserts and compacts for drill bits and other downhole tools associated with drilling and producing oil and gas wells. The present invention provides an insert or compact that substantially eliminates or reduces problems associated with the prior inserts and compacts for drill bits and other downhole tools associated with drilling and producing oil and gas wells.

In one aspect of the invention, a rotary cone drill bit is provided. The drill bit has a bit body attachable to a drill collar. A plurality of support arms have first and second ends and are attached to the bit body and extend outwardly and downwardly therefrom. A spindle is connected to each support arm and extends generally inwardly toward a center of the bit body. A cutter cone is rotatably attached to each spindle. The cutter cones each have a base surface, a side surface, and an end. The side surface of each cone has a plurality of sockets in spaced apart rows extending about the outer surface of the cone. Each of the inserts has a body having first and second portions. The first body portion of an insert is press fitted into a respective socket of a cone. The second body portion of the insert preferably consists of encrusted cubic boron nitride particles and tungsten carbide bound together with a binder material with the first and second body portions being fused together resulting in a unitary body. Each cubic boron nitride particle in the insert preferably has a generally cubic structure substantially free of heat degradation and any hexagonal crystalline structure which may result in response to fusing the various materials to form the unitary insert body.

In another aspect of the invention, inserts for a rotary cone drill bit are provided The drill bit has a plurality of cones with each of the cones having sockets for receiving a respective insert. Each insert has a body with first and second portions and may be of unitary construction. The first body portion is of preselected dimensions adapted for press fitting of the first body portion within a respective socket. The second body portion of each insert preferably includes encrusted cubic boron nitride particles, tungsten carbide, and a binder material. The components of each insert are preferably fused together to form a unitary body. The cubic boron nitride of the fused insert preferably has a generally cubic structure substantially free of heat degradation and resultant hexagonal crystalline structure which may form in response to fusing the components together in a preselected form in a single step of fusing or compacting. Each cubic boron nitride particle is preferably encrusted with a coating that has a thickness on the order of approximately one half the diameter of the respective cubic boron nitride particle.

Other technical advantages will be readily apparent to one skilled in the art from the following figures, descriptions and claims.

BRIEF DESCRIPTION OF THE DRAWINGS

For a more complete understanding of the present invention and its advantages thereof, reference is now made to the following brief description, taken in conjunction with the accompanying drawings and detailed description, wherein like reference numerals represent like parts, in which.

DETAILED DESCRIPTION OF THE INVENTION

Figure 1:
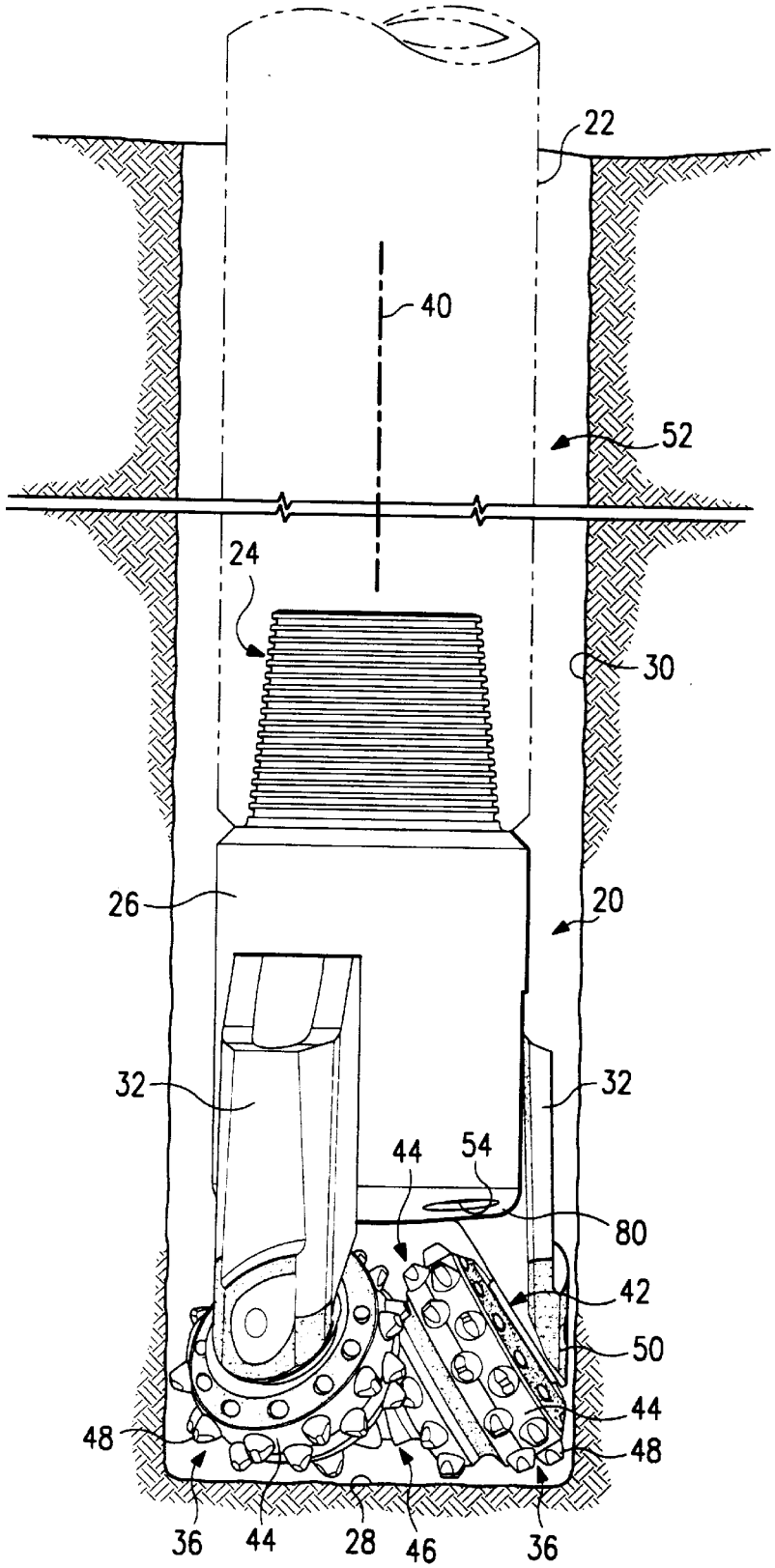
FIG. 1 is a schematic drawing in section and in elevation showing a drill bit with inserts or compacts formed in accordance with the teachings of the present invention at a downhole location in a wellbore.

The preferred embodiments of the present invention and its advantages are best understood by referring now in more detail to FIGS. 1–6 of the drawings, in which like numerals refer to like parts.

For purposes of the present application, the term "matrix body" is used to refer to various binders such as cobalt, nickel, copper, iron and alloys thereof may be used to form the matrix or binder portion of an insert or compact. Various metal alloys, ceramic alloys and cermets such as metal borides, metal carbides, metal oxides and metal nitrides may be included as part of the matrix body in accordance with the teachings of the present invention. Some of the more beneficial metal alloys, ceramic alloys and cermets will be discussed later in more detail.

For purposes of the present application, the terms "chemical bond" and "metallurgical bond" are used to refer to strong attractive forces that hold together atoms and/or molecules in a crystalline or metallic type structure.

For purposes of the present application, the terms "coating" and "coated" are used to refer to a layer of hard material which has been metallurgically bonded to the exterior of a cubic boron nitride particle. The term "encrusted" may also be used to refer to this same layer of hard material. The coating is preferably formed from sinterable materials including various metal alloys, ceramic alloys and cermets such as metal borides, metal carbides, metal oxides and metal nitrides. Some of the more beneficial metal alloys, ceramic alloys and cermets which may be used to form a coating on a cubic boron nitride particle in accordance with the teachings of the present invention will be discussed later in more detail.

For purposes of the present application, the term "tungsten carbide" includes monotungsten carbide (WC), ditungsten carbide ($W_2C$), macrocrystalline tungsten carbide and cemented or sintered tungsten carbide. Sintered tungsten carbide is typically made from a mixture of tungsten carbide and cobalt powders by pressing the powder mixture to form a green compact. Various cobalt alloy powders may also be included. The green compact is then sintered at temperatures near the melting point of cobalt to form dense sintered tungsten carbide.

For purposes of the present application, the term cubic boron nitride (CBN) refers to an internal crystal structure of boron atoms and nitrogen atoms in which the equivalent lattice points are at the corner of each cell. Boron nitride particles typically have a diameter of approximately one micron and appear as a white power. Boron nitride, when initially formed, has a generally graphite-like, hexagonal plate structure. When compressed at high pressures (such as 10 PSI) cubic boron nitride, which is similar to the hardness of diamond, will be formed. However, the mechanical strength of cubic boron nitride is generally low in comparison with many steel alloys.

For purposes of the present application, the term "insert" and the term "compact" will be used interchangeably to refer to cutting or grinding elements in earth boring drill bits and wear resistant elements associated with protecting drill bits and other downhole tools used for drilling and producing oil and gas wells. Inserts or compacts are often installed in a metal surface to prevent erosion, abrasion and wear of the metal surface.

Referring to FIG. 1, as is well known in the art and the petroleum industry, rotary drilling rigs rotate drilling bit 20 via drill collar 22 and a drill string (not shown). The drill bit 20 generally has three cutter cones 36. Additional information about this type of drill bit can be found in U.S. Pat. No. 5,606,895, entitled *Method for Manufacture and Rebuild a Rotary Drill Bit,* which is incorporated into this application by reference only. This type of drill bit is currently being marketed by Security DBS, a Division of Dresser Industries, as the "New ERA" drill bit.

The drill bit 20 has a bit body 26. The bit body 26 has a threaded upper section 24 adapted to be threadably attachable to the drill collars 22. A power source (not shown) may be located at the surface of the ground for rotating the drill string, drill collars 22 and attached drill bit 20 in forcible contact with the bottom 28 and sidewalls 30 of the bore hole being drilled (see FIG. 1). The present invention may be used with drill bits attached to downhole drilling motors (not shown) and is not limited to use with conventional drill strings.

A lower section of the drill bit 20 has a plurality of support arms 32 which are attached to the bit body and extend outwardly and downwardly from an outer surface 80 of the bit body 26. Generally, rotary cone bits for drilling hard formations have three support arms 32 and associated cutter cones 36 and are referred to as tri-cone rock bits.

A spindle (not expressly shown) is connected to each support arm 32 and extends generally inwardly and downwardly toward the center and axis of rotation 40 of the drill bit 20.

A cutter cone 36 is rotatably mounted on each of the spindles. Each of the cutter cones 36 has a base surface 42, a side surface 44 and an end 46. The side surface 44 of each cone 36 has a plurality of sockets (not shown) in spaced apart rows extending about the cone side surface 44.

Figure 2:
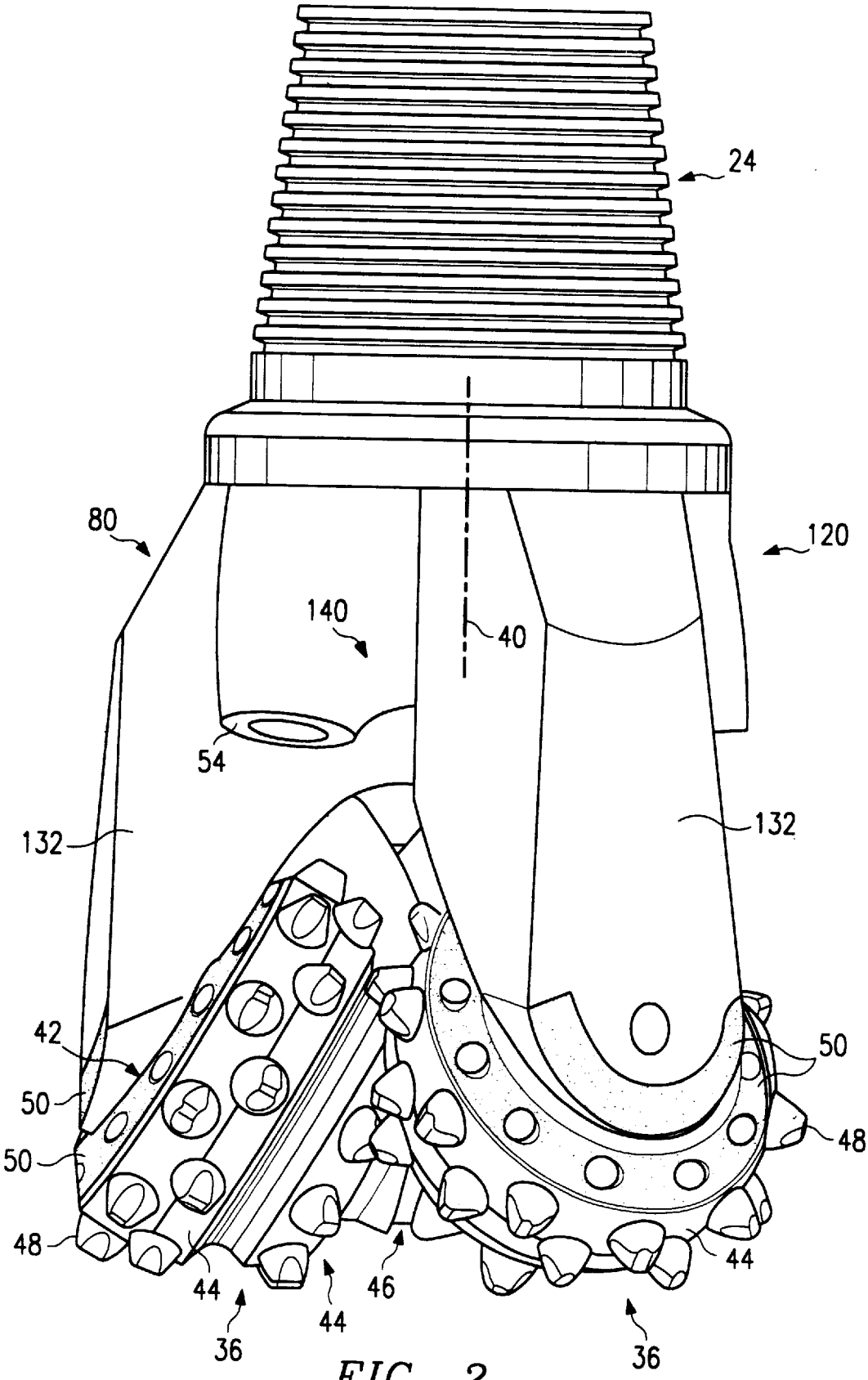
FIG. 2 is a schematic drawing in elevation showing another type of drill bit with inserts or compacts formed in accordance with teachings of the present invention.

Rotary cone drill bit 120 incorporating another embodiment of the present invention is shown in FIG. 2. Bit body 140 may be formed by welding three segments with each other to form bit body 140 having support arms 132 extending therefrom. Threaded connection 24 may be formed on upper portion of bit body 140 for use in attaching drill bit 120 to drill string 22. Additional information about this type of drill bit can be found in U.S. Pat. No. 5,429,200, entitled *Rotary Drill Bit With Improved Cutter*, which is incorporated into this application by reference only.

Referring to FIGS. 1 and 2, an insert 48 incorporating teachings of the present invention is preferably press fitted into each of the sockets and extends outwardly from the side surface 44 of the cone 36. The spindles and associated cones 36 may be angularly oriented and the inserts 48 are positioned such that as the drill bit 20 is rotated, the cones 36 roll along the bottom 28 of the bore hole and chip and grind off portions of the formation and form a bore hole having a diameter greater than the diameter of the bit body 26 and associated support arms 32 which partially defines annulus 52 to allow fluid flow to the well surface.

During drilling operations, great forces are exerted by the drill bit 20 on the formation. As expected, these large forces may cause the bit body to momentarily come in contact with the sidewalls 30 and be worn. Therefore, abrasion resistant material 50 sometimes referred to as "hardfacing" is generally placed on the lower portion of the support arms 32 to prevent the arms from being worn away causing failure of the drill bit 20. The abrasion resistant material 50 can be placed on other portions of the drill bit 20 which may be subject to undesirable wear.

The detrimental wear of portions of the drill bit 20 is not only caused by the sidewalls 30 of the drill bore, but by pieces of the formation that have been cut from the formation and are moving up the annulus 52 between the sidewalls 30 and the drilling equipment. These removed pieces of the formation are transported from the bore hole by drilling fluid (not shown) which is pumped down the drill string, drill collars 22, through the bit and forcibly from openings or nozzles 54 of the drill bit 20.

Figure 3A:
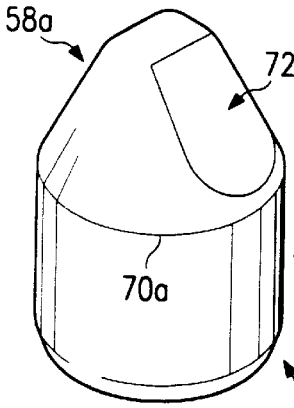
FIGS. 3A–3D are schematic drawings showing isometric views of inserts having different configurations incorporating teachings of the present invention.
Figure 3B:
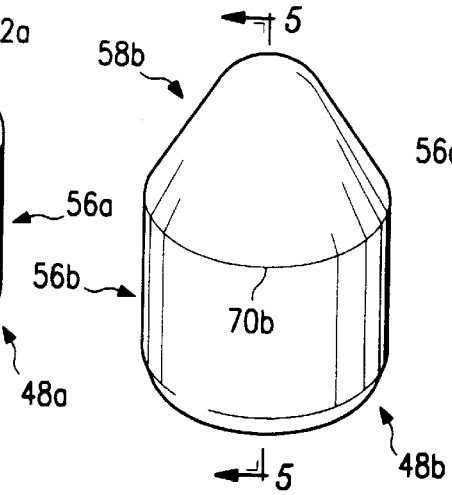
Figure 3C:
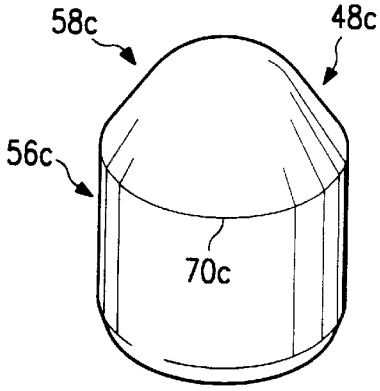

As shown in FIG. 3A, insert 48*a*, which contacts the formation and chips and grinds portions therefrom, has first and second portions 56*a* and 58*a*, respectively. The first portion 56*a* of the insert 48*a* may be press fitted into respective sockets of a cone 36. An interference fit between insert 48*a* and the bottom and sidewalls of each socket retain inserts 48*a* within its respective socket.

The first portion 56*a* of the insert 48*a* has a generally cylindrical configuration. However, recently it has been discovered that these insert first portions 56*a* and their associated sockets are sometimes advantageously formed with other configurations in order to improve the interference fit between the socket and its respective insert 48*a*.

Such non-cylindrical sockets and first portions 56*a* of the insert 48*a* each have a length, a width, and a depth and the depth is greater than about 0.8 times the width, the length is substantially less than or equal to 1.75 times the width, and the depth is in the range of about 1 to about 1.25 times the width. Preferably, the length is in the range of about 1.5 to about 1.6 times the width.

The second body portion 58*a* of the insert 48*a* is the element which contacts the formation during drilling and grinds pieces from the formation. As previously discussed, as the formation becomes more dense, it is necessary to shorten the length of an insert in order to produce more grinding forces. As shown in the various embodiments of FIG. 3, as the formation to be drilled becomes harder and more dense, the preferred configuration of the second portion 58 of the insert 48 will progress from embodiments 58*a*–58*d* as shown in FIGS. 3A–3D. It should be noted that the second portion 58*a* of insert 48*a* of FIG. 3A is longer and less dome shaped than the second portion 58*d* of the insert 48*d* of FIG. 3D. Therefore, the embodiment of FIG. 3D will typically produce greater drilling rates than the other embodiments when encountering extremely hard formations.

Figure 5:
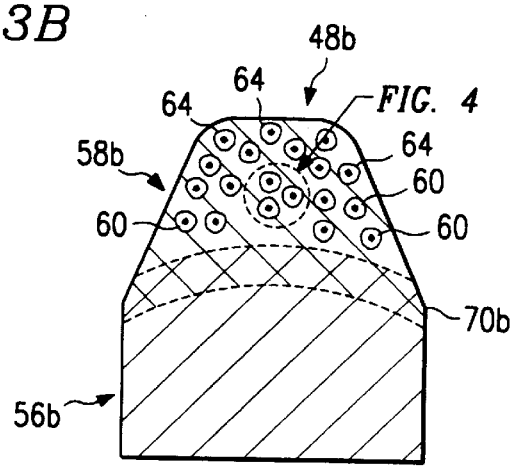
FIG. 5 is a schematic drawing in section taken along Line 5—5 of FIG. 3B showing one of many embodiments of an insert with wear resistant components incorporating teachings of the present invention.
Figure 4:
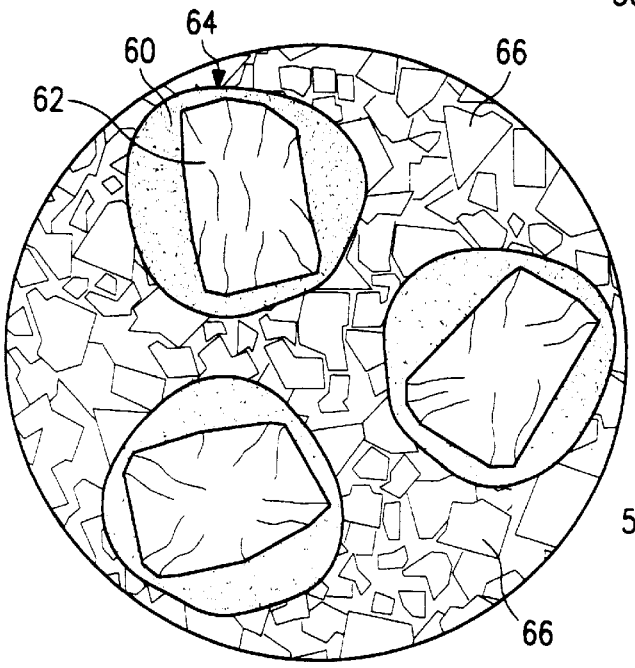
FIG. 4 is an enlarged schematic drawing in section showing a portion of a compact or insert having wear resistant components incorporating teachings of the present invention.
Figure 6:
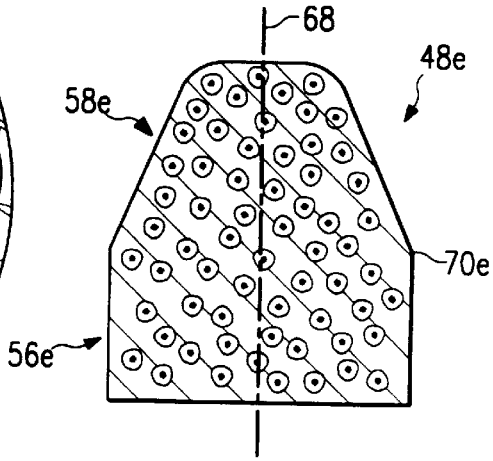
FIG. 6 is a schematic drawing in section showing an alternative embodiment of an insert with wear resistant components incorporating teachings of the present invention.

Referring to FIGS. 4–6, inserts or compacts incorporating teachings of the present invention preferably have at least the respective second portion 58 constructed with components having great abrasion resistance. The addition of various combination of elements to enhance abrasion resistance of the cutting portion of an insert is not new in the art. However, there is continuous effort in the industry to further improve the efficiency of drilling operations and hence the cutting elements associated with drill bits. It has been no surprise to research engineers in the petroleum industry that relatively minor and unique changes often produce greatly enhanced drilling efficiencies. Owing to the multiplicity of consistencies of rock formations, the design of drilling equipment is considered by many to be an art form as much as it is a science.

The second body portion 58 or rock grinding and crushing portion of an insert incorporating teachings of the present invention preferably includes encrusted cubic boron nitride particles, tungsten carbide, and a binder material selected from the group consisting of copper, nickel, iron, and/or cobalt-based alloys. More particularly, the preferred binding material for many downhole applications may be cobalt or cobalt-based alloys.

These components and elements are typically fused together with the first portion 56 of the respective insert to form unitary insert 48. The cubic boron nitride particles of the fused insert are generally cubic in structure and substantially free of heat degradation during fusing the components and elements together and into preselected form in a single step of simultaneous heating and compacting. Such heat degradation may result in boron nitride particles with relatively soft hexagonal crystalline structures.

Where overheating of an insert containing the components and elements of this invention is utilized, the undesirable hexagonal crystalline structure may form and the physical properties of hardness and toughness of the insert rapidly declines. Such decline in physical properties is not found where fusion takes place in a single, rapid compaction step which subjects the components and elements used to form the inserts in accordance with teachings of the present invention at lower temperatures.

A preferred method of forming the compacts and inserts of this invention is by Rapid Omnidirectional Compaction (ROC). This process is a low-cost process for consolidating high-performance prealloyed powders into fully dense parts. The process has the ability of producing intricate or simple shapes with very fine microstructure and excellent mechanical properties due to the relatively low thermal exposure given the prealloyed powders during the compaction process which is of short duration.

The Rapid Omnidirectional Compaction process is disclosed in U.S. Pat. No. 5,594,931, entitled *Layered Composite Carbide Product and Method of Manufacture,* U.S. Pat. No. 5,423,899, entitled *Dispersion Alloyed Hard Metal Composites and Method of Producing Same,* U.S. Pat. No. 4,956,012, entitled *Dispersion Alloyed Hard Metal Composites,* U.S. Pat. No. 4,744,943, entitled *Process for the Densification of Material Preforms,* U.S. Pat. No. 4,656,002, entitled *Self Sealing Fluid Die,* and U.S. Pat. No. 4,341,557, entitled *Method of Hot Consolidating Powder with a Recyclable Container Material,* each of which is incorporated into this application by reference.

In the ROC process used in forming inserts or compacts of this invention, compaction of the selected components and elements is accomplished during the heating process of the material which considerably and desirably shortens the time the cubic boron nitride particles are subjected to the possibility of heat degradation and resultant hexagonal crystalline structure formation, as may be experienced when forming articles by other processes. In the ROC process, a thick walled die having a cavity is typically employed. The die is preferably a fluid die whose die walls entirely surround the cavity and are of sufficient thickness so that the exterior surface of the walls do not closely follow the contour or shape of the cavity. This insures that sufficient container material is provided so that, upon the application of heat and pressure, the container material will act like a fluid to apply hydrostatic pressure to the various components and elements disposed in the cavity. The use of a thick-walled container produces a near net shape having close dimensional tolerances with a minimum of distortion. Inserts are precision articles having near net shapes which require minimum finish machining or often simple operations to produce a final desired shape.

A thick-walled container receives the prealloy powder of components and elements to be consolidated to form the desired densified powder compact or insert. The container preferably has first and second mating parts which, when joined together, form a cavity for receiving the powder material and particles. The container is formed of material which melts at a combination of temperature and time at that temperature which combination would not undesirably or adversely affect the properties of the encrusted cubic boron nitride particles.

The container is preferably formed of a material that is substantially fully dense and incompressible and capable of plastic flow at elevated temperatures and/or pressures. The container will melt at a combination of temperature and time at that temperature. The container can, for example, be formed of copper and the mold for forming the container can be formed of cast iron.

The container may be subjected to a melting temperature above that which would adversely affect the properties of the cubic boron nitride particles but for a short enough period of time that the heat would be taken up in the melting and the densification powder material would not itself reach a temperature level that would adversely affect its properties. Thus it is the combination of single step heating and short duration compaction that protects the encrusted cubic boron nitrides particles from undesirable structural change.

The container is preferably filled with the desired material for forming the insert or compact and thereafter hermetically sealed and positioned in a pressurizable autoclave. The filled container is simultaneously heated and pressurized. The temperature is maintained below the melting temperature of the material forming the container and the pressure is of a sufficient magnitude to cause plastic flow of the container walls, thereby subjecting the powder and particles to a hydrostatic pressure causing the powder to densify. The container can thereby be removed from about the formed insert or compact by various means known in the art.

In the method for forming inserts for a rock bit, the powder and particles of this invention can, for example, be subjected in the autoclave to a temperature of about 1000–1100° C., a pressure of about 10,000–50,000 psi for a time period of about one hour. A plurality of second metallurgical bonds are preferably formed between coating 60 and the matrix binder which forms each insert. The second metallurgical bonds cooperate with each other to retain coated cubic boron nitride particle 64 within the associated insert 48.

The cubic boron nitride particles are encrusted by an exterior coating of metal alloys and cermets selected from the group consisting of metal borides, metal carbides, metal oxides, and metal nitrides. The exterior coating of the cubic boron nitride particles can be formed in part from tungsten carbide. Tungsten carbide can also be incorporated in the filler material for adding strength thereto.

Encrustation or coating with a hard material protects the respective cubic boron nitride particles from heat associated with fusion of the various elements used to form the unitary body. However, as discussed previously, where the components and elements are subjected to a two-step process of heating and pressurizing to form the unitary body, undesirable nitride crystal structures often form irrespective of the presence of encrustation.

The hard material used to form the encrustation or coating 60, as best shown in FIG. 4, and the thickness of the coating 60 may be varied in response to the intended application. For some applications, each cubic boron nitride particle 62 will preferably be encrusted with coating 60 having a thickness on the order of approximately one half the diameter of the respective cubic boron nitride particle 62. As a result of this relatively thick coating or encrustation, each cubic boron nitride pellet 64 will have a diameter roughly twice the diameter of the respective cubic boron nitride particle 62. Coating 60 is preferably sintered after being placed on the respective cubic boron nitride particle 62 thereby forming coated cubic boron nitride particles or cubic boron nitride pellet 64. The sintering process is used to form coated hard pellets 64 having a density that is controllable relative to the other elements forming the respective insert 48. A plurality of first metallurgical bonds are preferably formed between coating 60 and the exterior of the associated cubic boron nitride particle 62.

Coated, hard cubic boron nitride pellets 64 may be uniformly dispersed within the second portion 58 of the associated insert 48 thereby providing an insert 48 of more uniform wear characteristics. A more uniform distribution of coated, hard cubic boron nitride pellets 64 also improves both the mechanical bonds and metallurgical bonds which secure the cubic boron nitride particles 62 with each insert 48.

Referring to FIG. 2, the coated, hard cubic boron nitride pellets 64 may be distributed in the second portion 58 in a range of about twenty-five percent to about seventy-five percent by volume of the materials in the second portion 58. For some applications the range will be about forty percent to about fifty percent coated, hard cubic boron nitride pellets 64. For other applications the second portion 58 may be formed from approximately one hundred percent coated, hard cubic boron nitride pellets 64.

As can be seen in FIG. 4 and as previously discussed, the second portion 58*b* of insert 48*b* includes generally uniformly dispersed encrusted cubic boron nitride pellets 64 with interspersed tungsten carbide particles 66 bound together by a binder. As the insert 48*b* wears away during drilling operations, the binder material, being softer and less tough, is the first to be eroded. This functions to further expose greater portions of the more abrasive tungsten carbide particles 66. As the tungsten carbide particles 66 become eroded the tougher and harder cubic boron nitride pellets 64 become more exposed and function to assume a progressive greater portion of the loads and abrasion imparted upon the insert 48*b*. This continuous action functions to prolong the effective life of the associated drill bit 20 or 120.

Cubic boron nitride particles 62 may be coated using various techniques such as those described in U.S. Pat. No. 4,770,907 entitled *Method for Forming Metal-Coated Abrasive Grain Granules* and U.S. Pat. No. 5,405,573 entitled *Diamond Pellets and Saw Blade Segments Made Therewith.* Both of these patents are incorporated by reference for all purposes within this application. Such coatings, as are taught in these patents, can be applied by various techniques known in the art such as pelletizing, chemical vapor deposition, physical vapor deposition, and/or chemical coating. These coating techniques may be modified as appropriate for cubic boron nitride particles. The preferred technique for the instant invention is the encrusting process described above.

It is preferred that the cubic boron nitride particles 62 are of substantially the same size prior to coating and forming the resultant encrusted cubic boron nitride pellets 64. However, in some applications it may be advantageous to have cubic boron nitride particles 62 of at least two different sizes prior to coating and forming the resulting encrusted cubic boron nitride particles 64. It may also preferred that substantially all of the encrusted cubic boron nitride pellets 64 have substantially the same density.

Referring to FIGS. 5 and 6, it can be seen that in some applications of drill bits 20 and 120 it will be preferred that the encrusted cubic boron nitride pellets 64 be substantially uniformly distributed in only the second body portion 58*b* of the insert 48*b*, as shown in FIG. 5. In other drill bit applications, it will be preferred that the encrusted cubic boron nitride pellets 64 be substantially uniformly distributed in both the first body portion 56*e* and second body portion 58*e* of insert 48*e*. There can also be applications for drill bit 20 or 120 where the first body portion 56*b* is also free of tungsten carbide particles 66.

As previously noted, the configuration of the second portion 58*b* of the insert 48*b* depends upon the toughness, density, and hardness of the rock expected to be drilled with the bit 20 or 120. The second body portion 58*b* of the insert 48*b* has a preselected length as measured along the insert axis 68 (see FIG. 6). This can readily be noticed by observing the dimensions of the second portions 58*a*–58*d* of the embodiments of FIG. 3 where the approximate dividing line between the first and second portions 56*a*–56*d*, 58*a*–58*d* of the insert 20 has been indicated generally at 70*a*–70*d*.

The embodiment of FIG. 3A has a second portion 58*a* which is relatively long and is of a chisel configuration where the outer end of the second portion 58*a* of the insert has one or more planar sides 72 defining a general tooth configuration. Such embodiment is particularly designed for the drilling of more easily drilled hard rock.

Figure 3D:
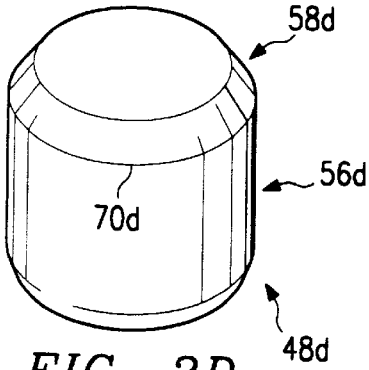

The embodiment of FIG. 3D has a second portion 58*d* which is relatively short and the outer end is planar. Such embodiment is particularly designed for the drilling of the most dense and hard rock. The other embodiments of FIG. 3 are of various domed configurations for the drilling hard rock whose difficulty in drilling is intermediate to the extremes set forth with regard to FIGS. 3A and 3D.

The inserts and compacts of this invention can also be used on other downhole drilling tools used in the petroleum industry. Examples of such uses, without limitation, are the placement of inserts and compacts on downhole tools such as fixed cutter drill bits, sleeves for drill bits, coring bits, underreamers, hole openers, downhole stabilizers and shock absorber assemblies.

In the operation of the present invention, the inserts are formed by pressurizing and heating of the elements. The resultant insert 48 is preferably free of heat degradation and resultant hexagonal crystalline structure in response to fusing the elements together and into preselected form in a single step of simultaneously heating and compacting the elements. The cubic boron nitride particles 62 are further protected from heat degradation by a protective coating which forms encrusted cubic boron nitride pellets 64.

During drilling operations the various materials forming the second portions 58*a*–58*e* of the inserts 48*a*–48*e* are progressively worn away in the order of their hardness thereby continuously exposing to abrasion greater portions of the most abrasion resistant materials of the inserts 48*a*–48*e*.

In accordance with the present invention, an insert may comprise coated ceramic particles and/or other coated particles of superabrasive and superhard materials which may be metallurgically bonded with a matrix body to form the desired insert. The coated particles are also mechanically held in place and protected by the surrounding matrix body which is preferably also formed from hard materials. Ceramic particles and other superabrasive or superhard particles satisfactory for use with the present invention may be commonly found as phases in the boron-carbon-nitrogen-silicon family of alloys and compounds. Examples of hard particles satisfactory for use with the present invention include silicon nitride ($Si_3N_4$), silicon carbide (SiC), boron carbide ($B_4C$) and cubic boron nitride (CBN). The coated particles are preferably dispersed within and both metallurgically and mechanically bonded with a matrix body formed from hard materials which are wear resistant. Cooperation between the wear resistance matrix body and the coated particles provides inserts and compacts which better withstand abrasion, wear, erosion, and other stresses.

One aspect of the present invention includes providing inserts with coated ceramic particles and other types of coated particles formed in part from superabrasive and superhard materials with the coated particles dispersed throughout each insert. Another aspect of the present invention includes providing inserts with one or more layers of hardfacing having coated or encrusted cubic boron nitride particles disposed therein. The resulting inserts are better able to withstand abrasion, wear, erosion and other stresses associated with repeated use in a harsh, downhole drilling environment.

Technical advantages of the present invention include providing inserts and compacts on selected portions of a drill bit to prevent undesired wear, abrasion and/or erosion of the protected portions of the drill bit. The coated or encrusted cubic boron nitride particles are preferably sintered prior to mixing with the other materials which will be used to form the inserts and compacts.

Technical advantages of the present invention include coating or encrusting ceramic particles such as cubic boron nitride particles or hard particles formed from other superabrasive and superhard materials and sintering the coating to form chemical or metallurgical bonds between the coating and the surface of the associate ceramic particle or other hard particle. Varying the composition of the coating and/or sintering the coating can also be used to vary the density of the resulting coated particles to be equal to or greater than the density of the hard materials used to form the associated matrix body prior to solidification. The coating on the hard particles can also be reinforced with small grains of boride, carbide, oxide and/or nitride which cooperate with other components of the matrix body to improve retention of the coated particles within the matrix body during erosion, abrasion and/or wear of the associated hardfacing.

The hard materials which will form the resulting matrix body and coated particles disposed therein are preferably rapidly compressed and heated to form chemical or metallurgical bonds between the matrix body and the coating on each particle. Both the matrix body and the coating can be formed from a wide variety of metallic and ceramic compounds in accordance with teachings of the present invention.

Further technical advantages of the present invention include coating or encrusting cubic boron nitride particles which will protect the associated cubic boron nitride particles from decomposition through exposure to high temperatures associated with forming compacts and inserts. As a result of the teachings of the present invention, the extreme hardness of cubic boron nitride particles and other ceramic particles or particles of superabrasive and superhard materials can be integrated into a slightly less hard but much tougher matrix body formed from materials such as tungsten carbide. The abrasion, erosion and wear resistance of the hard particles is augmented by the hard materials selected to form the respective coating for each hard particle. For example, when the hard materials selected to form the coating include cobalt, the tougher cementing phase of metallic cobalt will substantially improve the abrasion, erosion and wear resistance associated with cubic boron nitride particles.

Although the present invention has been described with several embodiments, various changes and modifications may be suggested to one skilled in the art. It is intended that the present invention encompass such changes and modifications as fall within the scope of the present appended claims.

What is claimed is:

1. An insert for a rotary cone drill bit, the drill bit having a plurality of cones with each of the cones having multiple sockets for receiving a respective insert, comprising:

a body having first and second matrix body portions with different compositions;

the first matrix body portion being of preselected dimensions adapted for press fitting of the first matrix body portion within the respective socket of one of the cones;

the second matrix body portion of the insert defining a cutting portion;

the second matrix body portion of the insert having encrusted cubic boron nitride pellets, tungsten carbide particles, and a binder material, fused together and the second body portion being fused to the first body portion of the insert to form a unitary body;

each encrusted cubic boron nitride pellet having a boron nitride particle with a generally cubic structure substantially free of heat degradation and resultant hexagonal crystalline structure;

each encrusted cubic boron nitride pellet further comprising a cubic boron nitride particle having a coating of hard material disposed on the exterior of the respective cubic boron nitride particle with a plurality of first metallurgical bonds formed between the exterior of each cubic boron nitride particle and the respective hard material coating; and the encrusted cubic boron nitride pellets encapsulated in the second matrix body portion with a plurality of second metallurgical bonds formed between the respective hard material coating on each cubic boron nitride particle and the second matrix body portion.

2. The insert, as set forth in claim 1, wherein the cubic boron nitride pellets are encrusted by an exterior coating of metal alloys and cermets selected from the group consisting of metal borides, metal carbides, metal oxides, and metal nitrides.

3. The insert, as set forth in claim 1, wherein the cubic boron nitride particles are of substantially the same size prior to coating and forming the resultant encrusted cubic boron nitride pellets.

4. The insert, as set forth in claim 1, wherein substantially all of the encrusted cubic boron nitride pellets have substantially the same density.

5. The insert, as set forth in claim 1, wherein the encrusted cubic boron nitride pellets are substantially uniformly distributed in only the second body portion of the insert.

6. The insert, as set forth in claim 1, wherein the encrusted cubic boron nitride pellets are substantially uniformly distributed in both the first and second body portions of the insert.

7. The insert, as set forth in claim 1, wherein the second body portion of the insert is generally free of encrusted cubic boron nitride pellets.

8. The insert, as set forth in claim 1, wherein the binder material comprises cobalt.

9. The insert, as set forth in claim 1, wherein the second body portion of the insert has a preselected length as measured along the insert axis, the length and the configuration of the second portion of the insert being preselected in response to the hardness of the material expected to be removed by the bit.

10. The insert, as set forth in claim 1, wherein the first body portion comprises a generally cylindrical configuration.

11. The insert, as set forth in claim 1, wherein the first body portion has a length, a width, and a depth, the length being in the range of about 1.5 to about 1.6 times the width.

12. The insert, as set forth in claim 1, wherein the first body portion has a length, a width, and a depth, the depth being substantially in the range of about 1 to about 1.25 times the width.

13. The insert, as set forth in claim 1, wherein an outer end of the second portion of the insert comprises general dome shaped configuration.

14. The insert, as set forth in claim 1, wherein the second portion of the insert comprises an outer end having a generally planar configuration.

15. The insert, as set forth in claim 1, wherein the second portion of the insert comprises an outer end having first and second opposed planar sides defining a general tooth configuration.

16. A rotary cone drill bit, comprising:

a bit body having a threaded upper section adapted to be threadably attached to a drill collar;

a plurality of support arms having first and second ends and being attached to the bit body and extending outwardly and downwardly therefrom;

a spindle connected to each support arm and extending generally inwardly toward a center of the bit body;

a cutter cone rotatably attached to each spindle, the cutter cones each having a base surface, a side surface and an end, the side surface of each cone having a plurality of sockets in spaced apart rows extending about the outer surface;

an insert press fitted into each socket, each of the inserts having a body with first and second body portions, said first and second body portions having different compositions;

the second body portion consisting of encrusted cubic boron nitride pellets and tungsten carbide particles bound together with a binder material and the first and second body portions being fused together to form a unitary body; and the encrusted cubic boron nitride pellets each having a cubic boron nitride particle with a generally cubic structure substantially free of heat degradation and resulting hexagonal crystalline structures.

17. The drill bit, as set forth in claim 16, wherein the cubic boron nitride particles are encrusted by an exterior coating of metal alloys and cermets selected from the group consisting of metal borides, metal carbides, metal oxides, and metal nitrides to form the cubic boron nitride pellets.

18. An insert for a downhole tool having a socket for receiving the insert, comprising:

a body having first and second matrix body portions of different compositions;

the first matrix body portion being of preselected dimensions adapted for press fitting of the first matrix body portion within a respective socket;

the second matrix body portion of the insert defining a cutting portion;

the second matrix body portion of the insert having encrusted cubic boron nitride pellets, tungsten carbide particles, and a binder material, fused together and said second body portion being fused to the first matrix body portion of the insert to form a unitary body;

each encrusted cubic boron nitride pellet having a boron nitride particle with a generally cubic structure substantially free of heat degradation and resultant hexagonal crystalline structure in response to fusing the insert;

each encrusted cubic boron nitride pellet further comprising a cubic boron nitride particle having a coating of hard material disposed on the exterior of the respective cubic boron nitride particle with a plurality of first metallurgical bonds formed between the exterior of each cubic boron nitride particle and the respective hard material coating; and the encrusted cubic boron nitride pellet encapsulated in the second matrix body portion with a plurality of second metallurgical bonds formed between the respective hard material coating on each cubic boron nitride particle and the second matrix body portion;

the first matrix body portion being substantially free of encrusted cubic boron nitride pellets.

19. The insert, as set forth in claim 18, wherein the cubic boron nitride pellets are encrusted by an exterior coating of metal alloys and cermets selected from the group consisting of metal borides, metal carbides, metal oxides, and metal nitrides.

20. An insert for a drill bit, comprising:

an attachment portion which is capable of being fixed to a rotary cone drill bit, said attachment portion comprising tungsten carbide in a metallic binder;

a cutting portion, integral with said attachment portion, comprising tungsten carbide and cubic boron nitride particles in a metallic binder;

wherein said attachment portion and said cutting portion have different compositions.

21. The insert of claim 20, wherein said cubic boron nitride particles are coated with an exterior coating of metal alloys and cermets selected from the group consisting of metal borides, metal carbides, metal oxides, and metal nitrides.

22. The insert of claim 20, wherein said metallic binder is selected from the group consisting of copper, nickel, iron, and/or cobalt-based alloys.

23. A rotary cone drill bit, comprising:

a body having a first end capable of being attached to a drill string and a plurality of arms at a second end;

a plurality of cones rotatably attached to said body;

a plurality of cutting inserts attached to said cones, ones of said inserts comprising a first portion which contains cubic boron nitride particles intermixed with tungsten carbide and a second portion which does not contain cubic boron nitride particles, wherein said cubic boron nitride particles do not exhibit any heat degradation.

24. The insert of claim 23, wherein said cubic boron nitride particles are coated with an exterior coating of metal alloys and cermets selected from the group consisting of metal borides, metal carbides, metal oxides, and metal nitrides.

25. The insert of claim 23, wherein said ones of said inserts further comprise a metallic binder selected from the group consisting of copper, nickel, iron, and/or cobalt-based alloys.

* * * * *